United States Patent [19]

Nakagawa et al.

[11] Patent Number: 4,575,053

[45] Date of Patent: Mar. 11, 1986

[54] CONTINUOUS ANNEALING APPARATUS

[75] Inventors: Kichizaemon Nakagawa; Takaaki Hira; Hideo Abe; Toru Sasaki; Yuji Shimoyama, all of Chiba, Japan

[73] Assignee: Kawasaki Steel Corporation, Kobe, Japan

[21] Appl. No.: 623,950

[22] Filed: Jun. 25, 1984

[30] Foreign Application Priority Data

Aug. 6, 1983 [JP] Japan ..... 58-144314

[51] Int. Cl.[4] ..... C21D 9/56

[52] U.S. Cl. ..... 266/92; 266/103; 226/180

[58] Field of Search ..... 266/102, 103, 109, 110, 266/111-113, 92, 93; 226/180, 189, 199; 148/156; 34/155

[56] References Cited

U.S. PATENT DOCUMENTS

| | | | |
|---|---|---|---|
| 2,451,394 | 10/1948 | Klein | 198/202 |
| 2,666,003 | 1/1954 | Dougherty et al. | 266/110 |
| 3,175,813 | 3/1965 | Costakis | 263/3 |
| 3,188,063 | 6/1965 | Costakis | 263/3 |
| 3,284,073 | 11/1966 | Engelhardt | 266/110 |
| 3,610,494 | 10/1971 | Minton . | |
| 4,375,283 | 3/1983 | Shimoyama et al. | 266/44 |
| 4,385,945 | 5/1983 | Compton et al. | 148/156 |

FOREIGN PATENT DOCUMENTS

| | | | |
|---|---|---|---|
| 0037752 | 10/1981 | European Pat. Off. . | |
| 0108328 | 5/1984 | European Pat. Off. . | |
| 3013840 | 10/1981 | Fed. Rep. of Germany | 226/189 |
| 1059559 | 2/1967 | United Kingdom . | |

OTHER PUBLICATIONS

DE-U-1 860 060 Siemens-ShuckertwerkeAktiengesellschaft 8-16-62-No translation.

*Primary Examiner*—Christopher W. Brody

*Attorney, Agent, or Firm*—Balogh, Osann, Kramer, Dvorak, Genova & Traub

[57] ABSTRACT

A continuous annealing apparatus for metal strips comprises cylindrical rolls each arranged at a location immediately before the metal strip passes about a hearth roll in a high temperature heat-treatment region of the apparatus. An axis of the cylindrical roll is finely tilted relative to the hearth roll within 0.15 degree in directions compensating for shifted distances of the metal strip on the hearth roll in response to every 50 mm shift of the strip, thereby preventing meandering and buckling of the metal strip caused by the hearth rolls.

4 Claims, 9 Drawing Figures

CONTINUOUS ANNEALING APPARATUS

BACKGROUND OF THE INVENTION

1. Field of the Invention

This invention relates to a continuous annealing apparatus having finely tiltable cylindrical rolls for guiding beltlike metals or metal strips adjacent to hearth rolls in a high temperature heat-treatment region of a vertical continuous annealing furnace for use in heat-treatment of the metal strips.

2. Description of the Prior Art

A continuous annealing furnace generally includes in series from an upstream to a downstream side a heating, a soaking and a cooling zone through which metal strips progressively pass so as to be properly heat-treated in accordance with various purposes.

In operation with such an apparatus, metal strips are often meandering or staggering in traverse directions and are buckling in the strips.

In order to avoid the meandering of the metal strips, it has been proposed to use hearth rolls having larger diameters at their midportions in the same manner as in belt pulleys. FIGS. 1*a* and 1*b* illustrate examples of such hearth rolls. The hearth roll shown in FIG. 1*a* has tapered ends. The hearth roll shown in FIG. 1*b* has a crowning outer circumferential surface. These hearth rolls serve to a certain extent to prevent metal strip from meandering. When tapered angles $\theta$ as shown in FIG. 1*a* or crowning amounts or curvatures $1/\rho$ shown in FIG. 1*b* are too large or tensile forces in longitudinal directions in the metal strips increase, then compressive stresses are caused by uneven tensile forces in the metal strips, which in turn give rise to buckling of the metal strips.

When the tapered hearth rolls 1*a* are used, the metal strips are likely to cause bucklings 3 at locations corresponding to taper starting lines of the rolls. Such bucklings spoil the appearance of the metal strip so as to lose their worth as products. In some extreme cases, moreover, the metal strips are broken off due to the bucklings resulting in a great trouble.

On the other hand, when the tapered angles or crowning amounts are reduced in order to avoid the bucklings, the performance of the hearth rolls preventing the meandering of the metal strips is lost to make impossible the proper transferring of the metal strips. In extreme cases, the metal strips are detached from the rolls and edges of the strips scrape the furnace walls to cause large troubles.

FIG. 3 is a graph symbolically illustrating this fact. A lower left shaded portion is a meandering zone and an upper right shaded portion is a buckling zone. Between these zones there is a narrow zone in which any meandering and buckling of metal strips do not occur. It is clearly evident that there are limited proper values of the tapered angles $\theta$ and curvatures $1/\rho$ of the hearth rolls. In general, metal strips to be treated in the continuous annealing furnaces are in wide ranges of dimension (thickness and width) and material (strength at high temperature and heat-treatment condition). The proper zone shown in FIG. 3 varies with these factors of metal strips. However, the shape of the hearth rolls were determined when the plant was constructed. Accordingly, the adaptability to the variation in metal strips is insufficient to avoid the buckling and meandering of the metal strips.

The inventors have proposed to use auxiliary small diameter rolls in order to prevent the buckling of metal strips due to the hearth rolls of annealing furances (Japanese Patent Application No. 188,257/82). The method using the auxiliary small diameter rolls exhibits significant effect for preventing the buckling but does not exhibit any improved effect for controlling the meandering in comparison with the prior art.

SUMMARY OF THE INVENTION

The inventors have carried out various experiments with various shapes of hearth rolls and operating conditions in order to prevent the buckling and to control the meandering. As the result, they have found that the buckling of metal strips can be completely avoided in the event that taper angles and crowning amounts of hearth rolls are zero or very small, and the position of the metal strips in traverse directions of the hearth rolls can be very easily controlled by changing parallelism between axes of the hearth rolls and separate cylindrical rolls arranged adjacent to the hearth rolls. They have completed this invention based on this discovery.

It is therefore an object of the invention to provide a continuous annealing apparatus which eliminates the above disadvantages of the prior art.

It is another object of the invention to provide a continuous annealing apparatus performing continuous annealing of metal strips under wide conditions with the aid of means capable of simultaneously fulfilling the imcompatible performance of prevention of meandering and buckling in the metal strips in general caused by hearth rolls.

To this end, a continuous annealing apparatus for metal strips according to the invention comprises cylindrical rolls each arranged at a location immediately before the metal strip passes about a hearth roll in a high temperature heat-treatment region of the apparatus, an axis of the cylindrical roll being finely tiltable relative to an axis of the hearth roll.

In a preferred embodiment of the invention, the cylindrical roll is supported at its ends by bearings, one of which is made shiftable transversely to an axis of the cylindrical roll by means of hydraulic means.

The invention will be more fully understood by referring to the following detailed specification and claims taken in connection with the appended drawings.

DETAILED DESCRIPTION OF THE PREFERRED EMBODIMENT

Figure 4:
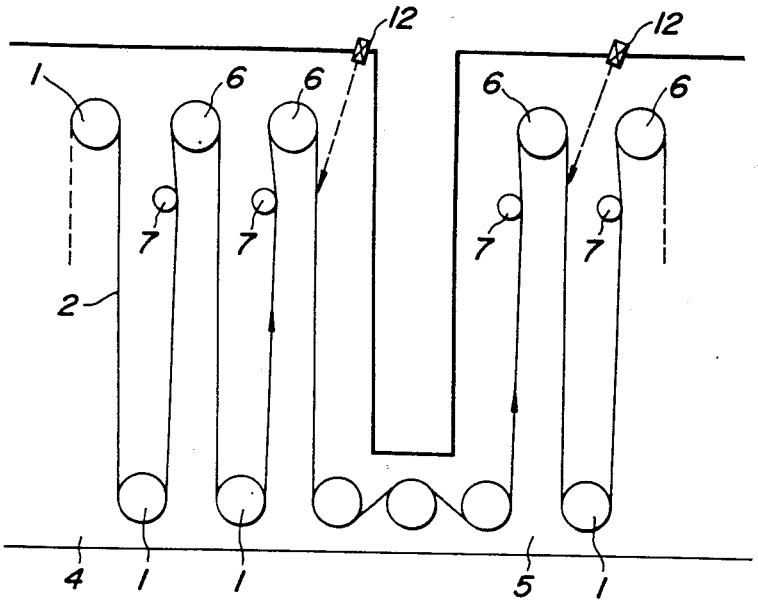
FIG. 4 is a schematic sectional view of a furnace including a vertical continuous annealing apparatus of one embodiment of the invention.

FIG. 4 illustrates a positional relation between rolls and a metal strip 2 in a heating zone 4 and a part of a soaking zone 5 in a high temperature heat-treatment region of a vertical continuous annealing furnace. In the annealing furance shown in FIG. 4, the two upper rolls in the heating zone near to the soaking zone 5 and the two upper rolls in the soaking zone near to the heating zone are hearth rolls 6 which do not have tapered portions or crowning. Immediately before each the hearth roll 6 in a path of the metal strip is a small diameter cylindrical roll 7 whose axis is finely tiltable from a parallel position relative to an axis of the hearth roll 6 by the use of means for sliding or moving at least one bearing on one end of the cylindrical roll 7.

The metal strip 2 moves in a direction shown by arrows in FIG. 4 in a manner that after the metal strip 2 has contacted each the finely tiltable cylindrical roll 7, it is trained about the hearth roll 6 having no taper portions or crowning eliminating the risk of buckling, and then passes about the next hearth roll 1.

Figure 5:
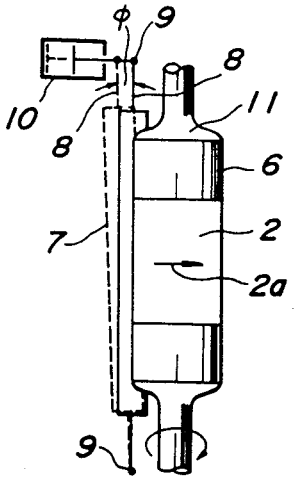
FIG. 5 is a schematic plan view of one embodiment of a tilting mechanism for a finely tiltable cylindrical roll according to the invention.

FIG. 5 illustrates a finely tiltable cylindrical roll 7 and a hearth roll 6 in a plan view, wherein a metal strip 2 moves in a direction shown by an arrow 2*a*. The finely tiltable cylindrical roll 7 is supported at its roll ends 8 by means of bearings 9, one of the bearings 9 being shiftable in horizontal directions traverse to an axis of the roll 7, for example, by means of a hydraulic cylinder 10. The axis of the small diameter cylindrical roll 7 can freely make a tilting angle $\phi$ relative to an axis 11 of the hearth roll 6 within a range corresponding to a stroke of the hydraulic cylinder.

The inventors have investigated in experiments how much change in transverse position of metal strips 2 is caused depending upon the variation in the tilting angle of the cylindrical roll 7. The result of the investigation will be explained hereinafter.

Figure 6:
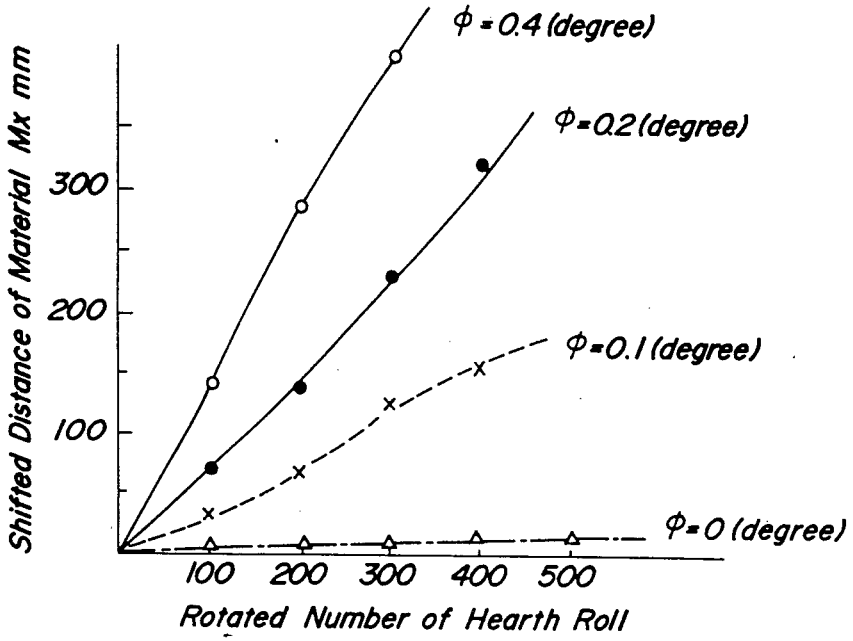
FIG. 6 is a graph illustrating relations between shifted distances of metal strips and tilting angles of the finely tiltable cylindrical rolls according to the invention.
Figure 7:
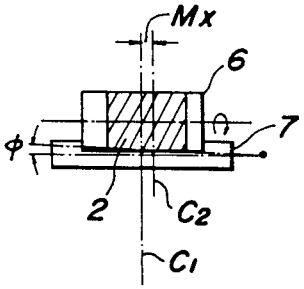
FIG. 7 is a schematic plan view illustrating the shift of a metal strip on a hearth roll caused by a tiltable cylindrical roll according to the invention.
Figure 8:
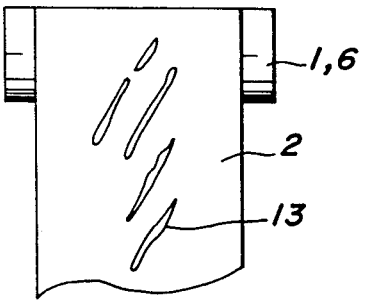
FIG. 8 is a front elevation of a metal strip in which buckling is caused by shearing force.

FIG. 6 shows relations between rotated numbers of hearth rolls and shifted distances Mx of strips 2 in traverse directions depending upon tilting angles $\phi$ of tiltable cylindrical rolls. FIG. 7 is a plan view for explaining FIG. 6, wherein Mx is a shifted distance of a center line $C_2$ of a metal strip 2 (shown by oblique stripes) from a center line $C_1$ of a hearth roll 6. At first, the metal strip 2 extended about the hearth roll 6 in a manner the center lines $C_1$ and $C_2$ were coincident with each other or $Mx=0$, and then the metal strip 2 was driven by the hearth roll 6. The shifted distance Mx of the metal strip 2 was measured with rotated numbers of the hearth roll 6, while the tilting angle $\phi$ of the finely tiltable cylindrical roll 7 in a horizontal plane relative to an axis of the hearth roll 6 was changed in various angles. As can be seen from FIG. 6, the rotated numbers of the hearth roll and the shifted distances Mx are in a linear relation or proportional to each other. In the event of the tilting angle $\phi$ of 0.2 degree, the metal strip 2 is shifted in its width direction by 75 mm per 100 rotations of the hearth roll. The larger the tilting angle $\phi$, the higher is the shifting speed (Mx/rotated number of hearth roll) of the metal strip as shown in FIG. 6. However, the tiltable cylindrical roll 7 tilted more than 0.5 degree is likely to cause shearing forces in the metal strip, which in turn cause oblique buckling 13 as shown in FIG. 8. It is therefore preferable to control the tilting angle $\phi$ within a range less than 0.4 degree.

The effect of the invention was ascertained in an actual apparatus, the result of which will be explained hereinafter. A finely tiltable cylindrical roll 7 capable of changing its tilting angle $\phi$ was provided by a device as shown in FIG. 5 in front of each of respective two hearth rolls 6 on outlet side of a heating zone 4 and on inlet side of a soaking zone 5, or immediately before each a turn of a metal strip about each the hearth roll 6 as shown in FIG. 4. The hearth rolls and tiltable cylindrical rolls did not have tapered portions and crowning and had radii of 300 mm and 150 mm, respectively.

Metal strips used in the experiment were metal strips, which were intended to be tin-plated to produce tin plates, having a thickness 0.3 mm and a width of 900 mm, and very low-carbon steel strips having a thickness of 0.7 mm and a width of 1,320 mm. These strips were passed through the apparatus at a speed 200 m/min to be heat-treated. A temperature in the soaking zone was 810° C.

Television cameras 12 for industrial use were arranged at locations shown in FIG. 4 to monitor the meandering of the strips. The tilting angle $\phi$ of each the tiltable cylindrical roll was changed by 0.15 degree in directions compensating for shifted distances in response to every 50 mm shift in the traverse direction of the strip detected by the television camera 12. Table 1 shows the meandering and buckling of the above strips in comparison of the apparatus according to the present invention and the prior art apparatus having tapered hearth rolls. In the Table 1, marks of ⊙, Δ and x denote "good", "a little bad" and "bad", respectively.

TABLE 1

| Kind of steel strip | Dimension (thickness × width) | Apparatus | Meandering of strip | Buckling in strip |
|---|---|---|---|---|
| Steel strip for tin plate | 0.3 mm × 900 mm | Prior art | X Large meandering | Δ Shearing buckling due to meandering |
| | | Present invention | ⊙ Small meandering (with adjustment of tilting angle $\phi$ within 0.15°) | ⊙ No buckling |
| Very low-carbon steel | 0.7 mm × 1,320 mm | Prior art | ⊙ Small meandering | X Buckling at shoulder of roll |
| | | Present invention | ⊙ Small meandering (with adjustment of | ⊙ No buckling |

TABLE 1-continued

| Kind of steel strip | Dimension (thickness × width) | Apparatus | Meandering of strip | Buckling in strip |
|---|---|---|---|---|
| | | | tilting angle $\phi$ within 0.15°) | - |

In case of the metal strips for tin plates, they greatly meandered in the prior art apparatus to cause shearing forces in the strips resulting in oblique buckling as shown at 13 in FIG. 8. In contrast herewith, with the apparatus according to the invention the meandering and buckling were completely prevented by controlling the tilting angles $\phi$ of the finely tiltable cylindrical rolls within 0.15 degree.

Figure 1A:
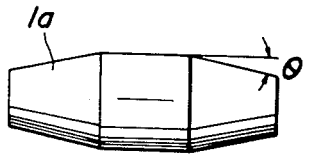
FIG. 1a PRIOR ART
FIG. 1*a* is a front elevation illustrating an external appearance of a hearth roll having tapered ends of the prior art.
Figure 2:
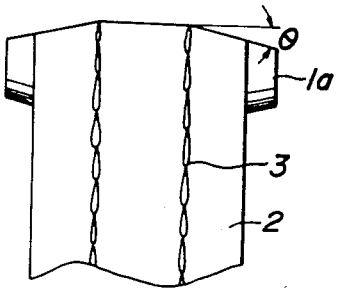
FIG. 2 PRIOR ART
FIG. 2 is a front elevation illustrating bucklings occuring in a metal strip at shoulders of a hearth roll of the prior art.
Figure 1B:
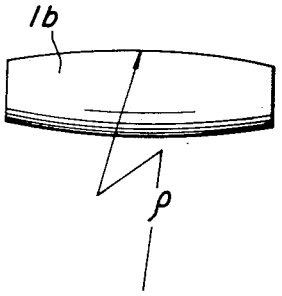
FIG. 1b PRIOR ART
FIG. 1*b* is a front elevation illustrating an external appearance of a hearth roll having crowning of the prior art.
Figure 3:
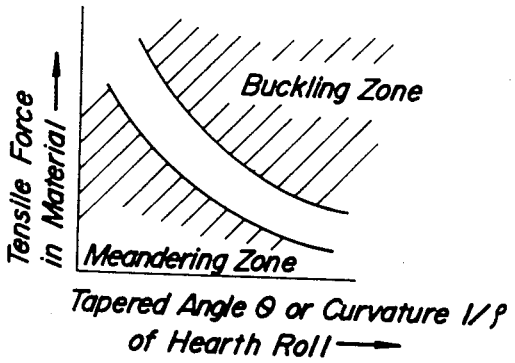
FIG. 3 is a graph symbolically illustrating relations between tapered angles or curvatures of hearth rolls and buckling and meandering of metal strips.

In case of the very low-carbon steel strips, with the prior art apparatus they did not meander but exhibited buckling 3 in the strips at locations corresponding to shoulders of the hearth rolls as shown in FIG. 2. With the apparatus according to the invention, such a buckling was not caused because the hearth rolls are completely cylindrical. With the apparatus according to the invention, moreover, without the control by the finely tiltable cylindrical rolls 7, the meandering of the strips was larger than that of the prior art, but such a meandering was completely avoided by controlling the tilting angle $\phi$ within 0.15 degree.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A continuous annealing apparatus for metal strips, said apparatus comprising a hearth roll and a cylindrical roll arranged at a location immediately before a metal strip passes about said hearth roll in a high temperature heat-treatment region of the apparatus, an axis of said cylindrical roll being finely tiltable within a 0.15° angle relative to an axis of said hearth roll, bearings for supporting said cylindrical roll at the ends thereof, and hydraulic means for making one of said bearings shiftable transversely to the axis of said cylindrical roll.

2. A continuous annealng apparatus as set forth in claim 1, wherein said high temperature heat-treatment region is in a vertical continuous annealing furnace.

3. A continuous annealing apparatus as set forth in claim 2, further comprising a plurality of upper hearth rolls and a plurality of cylindrical rolls, wherein each of said plurality of cylindrical rolls is arranged at a respective one of said plurality of upper hearth rolls in a heating zone near to a soaking zone and at a respective one of said plurality of upper hearth rolls in the soaking zone near to the heating zone.

4. A continuous annealng apparatus as set forth in claim 1, wherein said apparatus comprises monitoring means including a television camera to monitor meandering of the metal strip on the hearth roll, said cylindrical roll being tilted in a manner compensating for a shifted distance of the strip detected by the monitoring means.

* * * * *